United States Patent [19]

Colson et al.

[11] Patent Number: 4,913,210

[45] Date of Patent: Apr. 3, 1990

[54] CORD LOCK FOR WINDOW SHADES

[75] Inventors: Wendell B. Colson, Boulder; Terry Akins, Louisville, both of Colo.

[73] Assignee: Hunter Douglas Inc., Upper Saddle River, N.J.

[21] Appl. No.: 306,355

[22] Filed: Feb. 6, 1989

[51] Int. Cl.[4] ..... E06B 9/38

[52] U.S. Cl. ..... 160/84.1; 160/178.2

[58] Field of Search ..... 160/178.1, 84.1, 178.2

[56] References Cited

U.S. PATENT DOCUMENTS

| | | | |
|---|---|---|---|
| 2,172,657 | 9/1939 | Haase | 160/178.2 X |
| 3,130,776 | 4/1964 | Van Thienen | 160/178.2 |
| 4,450,027 | 3/1984 | Colson . | |
| 4,603,072 | 1/1986 | Colson . | |
| 4,660,612 | 2/1987 | Anderson . | |

FOREIGN PATENT DOCUMENTS

| | | | |
|---|---|---|---|
| 0059807 | 9/1982 | Japan | 160/178.2 |

OTHER PUBLICATIONS

1985 Brochure for "Luxaflex" products, in Dutch.

*Primary Examiner*—Blair M. Johnson
*Attorney, Agent, or Firm*—Pennie & Edmonds

[57] ABSTRACT

An improved cord lock for a window shade is described. The cord lock comprises a molded body member in which are formed first and second cord bearing surfaces and a locking dog support. The cord bearing surfaces are shaped to direct the cords laterally outwardly of the shade member and so that the cords tend to avoid becoming tangled. The locking dogs are arranged such that the cord is secured automatically upon release, thus providing "crash-proof" operation. A shroud formed of a different material than the molded body member encloses its periphery. This provides a particularly attractive appearance for the completed unit.

28 Claims, 3 Drawing Sheets

CORD LOCK FOR WINDOW SHADES

FIELD OF THE INVENTION

This invention relates to an improved window shade. More particularly, this invention relates to a window shade comprising an improved cord locking mechanism.

BACKGROUND OF THE INVENTION

This invention relates to improvements in window shades comprising a headrail, adapted to be mounted to a window frame or the like, a collapsible and extensible shade member, typically but not necessarily a cellular shade member as shown in among others U.S. Pat. Nos.4,450,027 and 4,603,072, cords for raising and lowering the shade member, and a cord lock for securing the cords with respect to the headrail in order to hold the shade member in any particular position desired.

Conventional shades of this type may be considered for the purposes of the present application to have been manufactured according to one of two particularly pertinent designs. Of course, various other shades are known as well. In a first design, referred to herein as the "European"design, which has been on sale for several years, the cords are fixed to a lower edge of the shade member, extend upwardly to the upper end of the shade member, are guided by guide means in the headrail towards one end thereof and thence along the headrail into a cord lock. In the European design, the body of the cord lock is a molded member comprising two integral cord guides. The first cord guide is a vertical cylindrically-curved surface around which the cords are wrapped, changing their direction from parallel to the headrail to outwardly, perpendicular to the plane of the shade member. A second cylindrical member which is curved about a horizontal axis then directs the cords downwardly. A locking dog mechanism, comprising a first dog member pivoted on a support also formed integrally with the body of the cord lock and a second dog member pivoted on the first dog member, is provided to secure the cord with respect to the cord lock.

The orientation of the pivot point of the dogs with respect to the shade member determines the direction in which the cords are moved by the user to cause the dogs to release or to grip the cords. In the European design, the cords make a 90° turn upon redirection from the headrail to the locking dog assembly, and the dogs are positioned such that the cords are moved in a plane generally perpendicular to the plane of the shade member to control it. This is generally not as desirable as an arrangement in which the cords are moved parallel to the shade member, i.e., side-to-side in front of the shade member.

The design of the European design cord lock also was not "crash-proof" , i.e., if the cords were released abruptly by the user, the dogs did not always grip the cord, so that the shade was permitted to fall to its maximum extent; this can be very damaging.

The design of the European design cord lock also exposed the ends of a rivet on which the first dog member was pivoted to the body of the cord lock. For esthetic reasons this is undesirable, and it was desired to conceal this rivet if possible.

The body of the cord lock of the European design was exposed to view, so that if it were to be color coordinated with the remainder of the shade, its material had to be one which accepted color readily. This prevented use of certain functionally-desirable plastics.

A second comparable design which has also been on sale for some years is referred to herein as the "U.S.'-'design. U.S. Pat. No. 4,660,612 to Anderson shows several versions of this design. In this design, the cords again pass around a first guide surface which is curved about a vertical axis and then downwardly over a second guide surface which is curved about a horizontal axis. The cords receive approximately 90° or 135° of redirection about the first curved guide surface before being directed downwardly over the second curved guide surface. This provides relatively substantial frictional drag on the cord, which can lead to difficulty in its operation.

In the U.S. design, the locking dog mechanism is pivoted on a rivet extending through a shroud which is separately assembled to the basic molded body of the cord lock, in which the first and second guide surfaces are integrally molded. In the Anderson patent, the guide surfaces are provided as part of a separate wear-resistant insert. In either case, the shroud can be readily color matched to the remainder of the shade, while allowing the guide surfaces to be formed of a mechanically preferred material. However, the dogs are not located as precisely with respect to the guide surfaces as they would be if their support were molded integrally therewith, as in the European design. Further, the U.S. design also allows the user to see the rivet about which the locking dog mechanism is pivoted, which is generally undesirable, as mentioned above.

The U.S. design is crash-proof, meaning that if the cords are simply released the dogs will grip the cords and prevent the blind from crashing to its maximum extent. On the other hand, the disposition of the dogs with respect to the bearing surfaces is such that the cords at all times are under tension urging them against the dogs; excessive cord wear can result if a rough surface is provided on either of the dogs. This necessitates that the dogs be deburred in the assembly process, which adds somewhat to the cost of the shade.

Thus, both the U.S. and the European designs, while successful commercially, still offer some room for improvement. In particular, the designs of both these cord locks occasionally cause the cords to twist about one another and become tangled.

SUMMARY OF THE INVENTION

Accordingly, it is an object of the invention to provide an improved cord locking structure for a window shade, wherein the dogs and the cord guide bearing surfaces are located precisely with respect to one another so that inaccuracies in assembly are eliminated, and wherein tangling of the cords is also substantially eliminated.

It is a further object of the invention to allow optimal choice of material for a molded cord lock body member comprising much of the cord lock structure, while a separate shroud is provided to conceal the cord lock, whereby the materials of both can be chosen for differing desirable characteristics, and whereby the cord lock body member need not be of any particular color.

It is a further object of the invention to provide a cord lock for a window shade in which the rivet by which the dog locking assembly is supported is concealed from the view of the user.

It is a further object of the invention to provide a cord lock for a window shade with generally improved operational characteristics.

Other objects of the invention will appear as the discussion below proceeds.

The present invention satisfies the needs of the art and objects of the invention mentioned above by provision of an improved cord lock structure for a window blind. The cord lock comprises a main molded body member in which are formed first and second integral cord bearing surfaces. The first cord bearing surface offsets the cord laterally outside of the shade, and the second cord bearing surface directs the cord downwardly. The cord bearing surfaces are slanted with respect to the horizontal and shaped such that parallel cords do not tend to twist, whereby tangling of the cords is eliminated. Preferably, a third guide is formed integrally with the body member as well, and directs the cords from the interior of the headrail to the first bearing surface. The cord lock body member also comprises an integral support for the locking dog mechanism, whereby the locking dogs are located precisely with respect to the second bearing surface. A first dog member is secured to the dog support by a pivot pin. The pin may be headed only on one side and be retained in the dog support by a shroud snapping over the molded body member. The shroud essentially surrounds the molded body member and is formed of a different material than the molded body member. The body member is formed of a low friction plastic, and the shroud is formed of a cosmetically desirable material, e.g., one which readily accepts color, so that the cord lock assembly can be color-coordinated with the remainder of the shade.

BRIEF DESCRIPTION OF THE DRAWINGS

The invention will be better understood if reference is made to the accompanying drawings, in which:

FIG. 4 shows the cords and dogs in the "engaged" position in full, and in the "locked" and "unlocked" positions in dotted lines.

DESCRIPTION OF THE PREFERRED EMBODIMENTS

Figure 1:
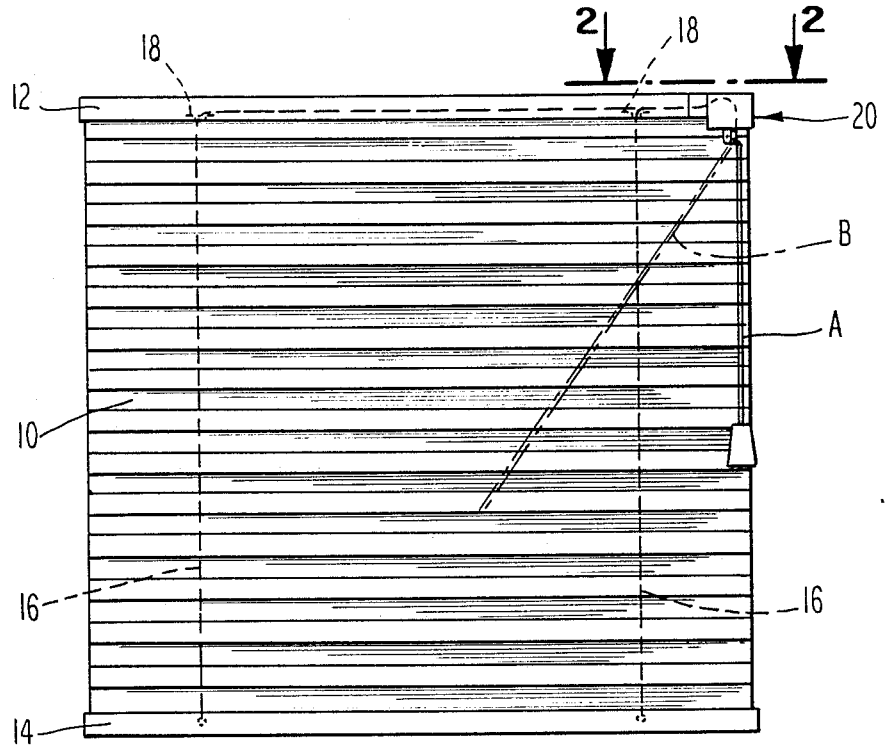
FIG. 1 shows a overall front view of the shade according to the invention, with the cords shown in the "engaged" position in full and in the "unlocked" position in dotted lines.

FIG. 1 shows as mentioned an overall front view of the shade according to the invention. The shade comprises an expansible and collapsible shade member 10, which is hung from a headrail 12 and may have a foot rail 14 at its lower end. Two or more cords 16 (in some cases, as many as eight) extend from a lower surface of the shade member 10 or from the foot rail 14 up through the shade 10 into the headrail 12 and to a cord lock indicated generally at 20. Guides 18 may be provided in the headrail to direct the cords 16 from within the headrail toward the cord lock 20. The cords 16 hang vertically as indicated at A when in the engaged position, and are moved to a second unlocked position indicated in dotted line at B when the user desires to raise or lower the shade. This causes the cord lock 20 to release the cords, in a manner described in detail below, whereby the shade member can be raised or lowered as desired.

The cord lock mechanism 20 is detailed in connection with FIGS. 2, 3, and 4. The cord lock 20 comprises a first molded body member 22. The body member 22 comprises a reduced section tongue portion **22*a*, which fits within a corresponding recess formed in the headrail 12 and is retained therein. The cords 16 are directed around a first inclined guide surface 22*b* in their passage between the interior of the headrail and the locking dog assembly, which is indicated generally at 30. This guide surface 22*b* is inclined inwardly toward the cords, as shown, to guide the cords downwardly. A horizontal guide member 22*c* (shown cutaway in FIG. 2) is formed integrally with the guide surface 22*b* and extends from its upper end, to retain the cords in the correct path. After passage over the first inclined guide surface 22*b*, the cords pass over first and second angled bearing surfaces 32 and 3** respectively.

The first angled bearing surface 32 is generally curved uniformly along an axis lying in a plane perpendicular to the plane P of the shade member, and is sloped downwardly, away from the headrail 12, thus directing the cords 16 laterally outwardly, beyond the plane P of the shade member 10. The second angled bearing surface 34 is generally also curved uniformly along an axis lying in a plane perpendicular to the plane P of the shade member, but is angled in the opposite sense than the first bearing member 32, that is, inwardly toward the headrail 12, so as to direct the cords 16 downwardly. The curved guide surfaces 32 and 34 are curved uniformly along their axes, but are not necessarily cylindrical. Typically the first bearing surface 32 is inclined at a larger angle with respect to the horizontal than is the second bearing surface 34, so that the cords run downwardly from the first bearing surface 32 to the second bearing surface 34.

The design of the angled bearing surfaces 32 and 34 is such that if a flat ribbon is passed over the first and second angled bearing surfaces 32 and 34 it lies properly thereagainst. When this condition is met, two or more (as noted, up to eight) cords 16 will similarly tend to lie adjacent one to another, which substantially avoids tangling of the cords. This was not possible with the vertical and horizontal cylindrical-surfaced guide pins found in the prior European and U.S. designs discussed above. Moreover, since according to the invention the cords are simply displaced laterally outwardly by the bearing surfaces, they are redirected less than in the prior designs. Friction and wear are thus reduced.

Also formed integrally with the molded member 22 is a dog support **22*d*. The dog support 22*d* has formed therein a through hole indicated at 22*e* which receives a pin 40. The pin 40 passes through hole 22*e* and through corresponding holes in ears formed on either side of a central portion of a first dog member 42, which is thus pivoted for rotation about the pin 40. This arrangement for mounting the dog member 42 is somewhat more compact for a given width of the dog than one in which the dog is located between projecting supports. A second dog member 46 is mounted to the first dog member 42 by a second pivot pin 44, which extends through corresponding holes in the ears of the second dog member 46 and in the ears of the first dog member 42. The axes of pivot pins 40 and 44 are generally parallel to the axis along which the second bearing surface 34** is uniformly curved.

Figure 4:
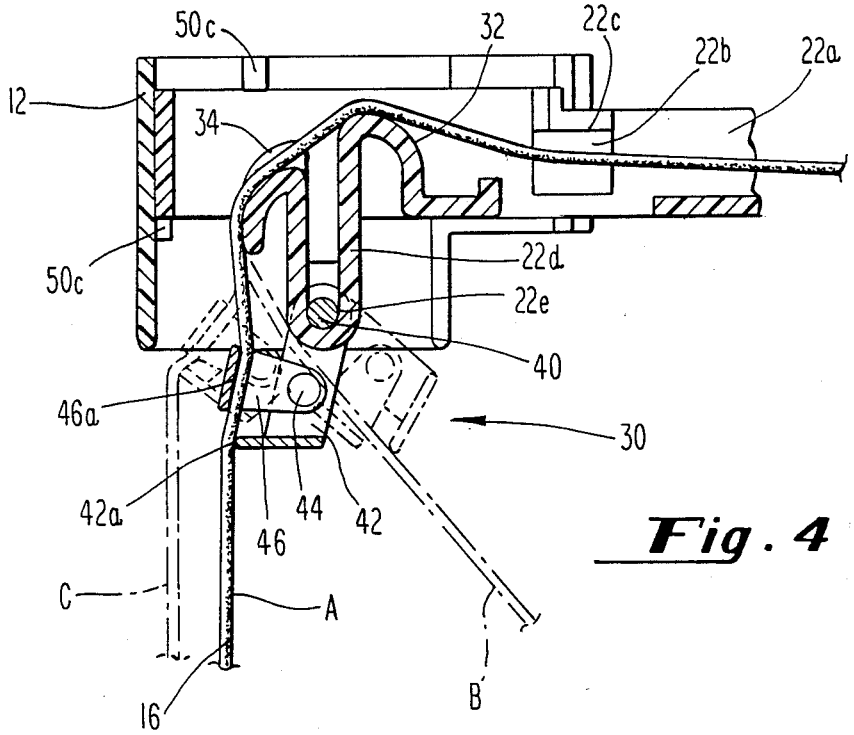
FIG. 4 is a cross section generally along the path of the cord as indicated at 4—4 in FIG. 2, viewed from the rear of the shade.

As shown in FIG. 4, the cords run between the central portions of the first dog member 42 and the second dog member 46, which thus form opposed gripping surfaces 42*a* and 46*a* respectively. The pivot point defined by pin 40 is located in a plane perpendicular to the plane P of the shade, that is, parallel to but offset from the plane containing the axis along which the second bearing surface 34 is uniformly curved. This arrangement is such that when the cords 16 hang freely, in the position shown in full in FIG. 4, opposed gripping surfaces 42*a* and 46*a* touch the cord. If the cords 16 are simply released, the gripping surfaces engage cords 16 and secure them with respect to the molded body member 22 and thus to the headrail 12, preventing motion of the shade member, and thereby "crash-proofing" the shade.

More specifically, FIG. 4 shows as mentioned the "resistance" position A taken by the cords and dog members when the cord is released in full, and the "unlocked"position B and the "locked" position C in dotted lines. In the resistance position A, shown in full, the second dog 46 is urged under the influence of gravity towards the first dog 42. The relationship of the pivot point 40 of the first dog to the second guide surface 34 is such that the cords 16 contact the central portion of the second dog 46 which forms the gripping surface 46*a* along parallel lines. Relatively substantial drag is then created between the dogs and the cords. If the cords are then released, the weight of the shade 10 causes the cords 16 to be drawn rapidly upwardly with respect to the dogs 42 and 46. The drag between the cords 16 and the dogs in this "resistance" position A causes the cords to be engaged by the dogs, rather than sliding through the dogs. The first dog 42 then tends to rotate clockwise about pivot point 40 into a locked position C, in which the first dog is nearly horizontal. When a user subsequently desires to release the cords, he simply pulls the cords downwardly toward the unlocked position B. Tension on the cords then positively urges the second dog 46 away from the first dog 42. In this position, the gripping surface 46*a* of the second dog 46 only touches the cords at its edge, if at all, thus releasing the cords. The dogs thus are not urged against the cords 16 in the released position, which reduces wear on the cords as compared to other arrangements.

Other conventional cord gripping mechanisms, such as rotable toothed wheels which frictionally engage the cords, are within the scope of the invention where not excluded by the following claims.

The body member 22 is preferably formed of a low friction plastic material, e.g., that sold as "Ultem." This material does not accept color well. Moreover, it would be costly to manufacture and stock this relatively massive and complex part in a wide variety of colors. In order that the overall assembly can be colored attractively, a shroud 50 is provided. The shroud 50 snaps around the visible portion of the periphery of the molded body member 22. The shroud 50 is formed of a material, e.g., polycarbonate, that does accept color well. The shroud is a comparatively simple, low-mass part which can readily be molded in all colors desired for headrails. In this way, the cord lock 20 can readily be color coordinated with the headrail, the foot rail, and the shade assembly. This allows this practice to be followed even though the molded body member 22 may not be of a desirable color. The shroud 50 can also be used to retain the pivot pin 40 in the dog assembly as shown in FIG. 3, whereby pin 40 need only be peened or headed (as shown at 41) on one end. This simplifies manufacture of the cord lock somewhat. The pin 40 is thus also not visible to the user, which contributes to the shade's appearance.

Figure 2:
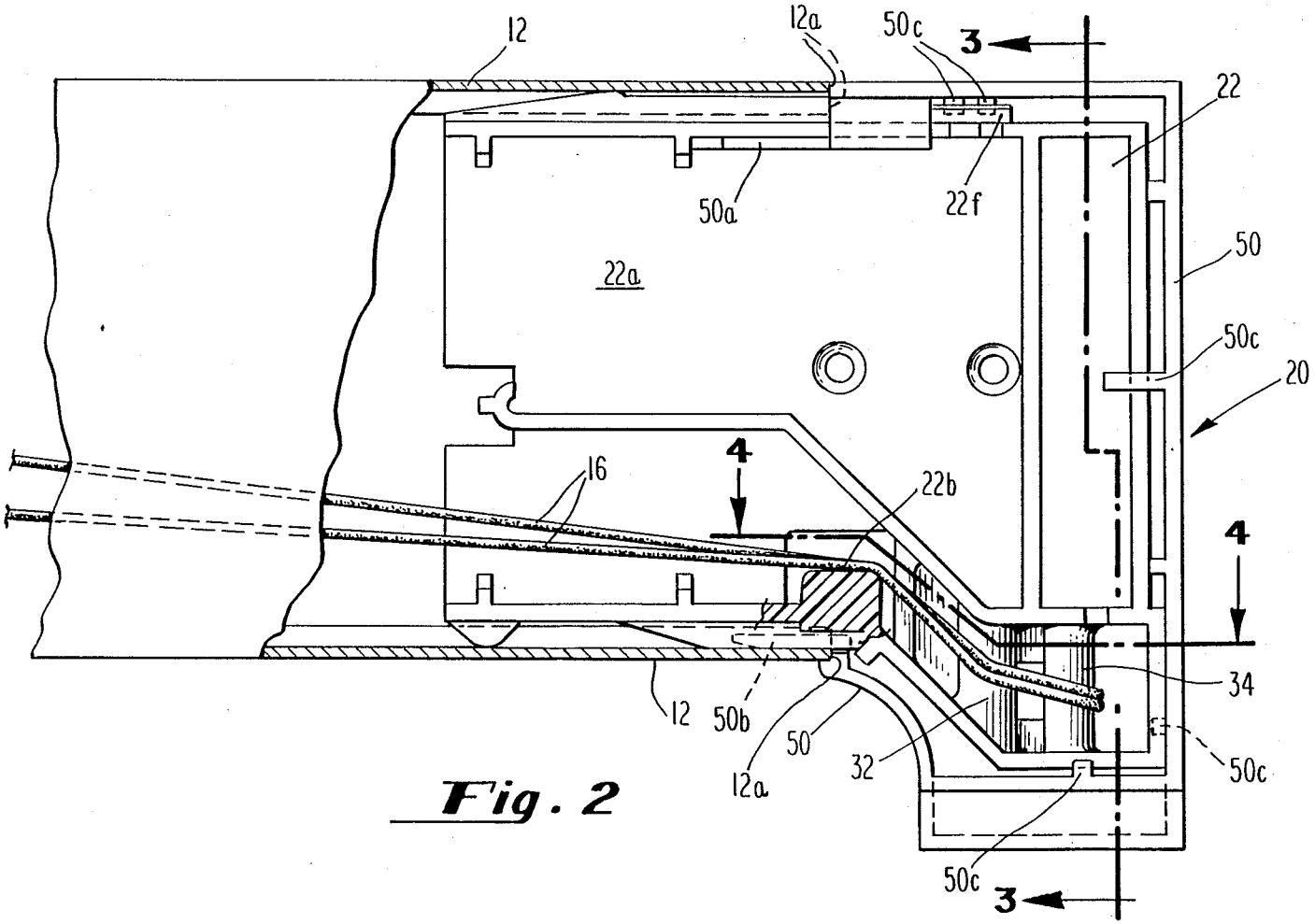
FIG. 2 shows a fragmentary top view of the shade of the invention.
Figure 3:
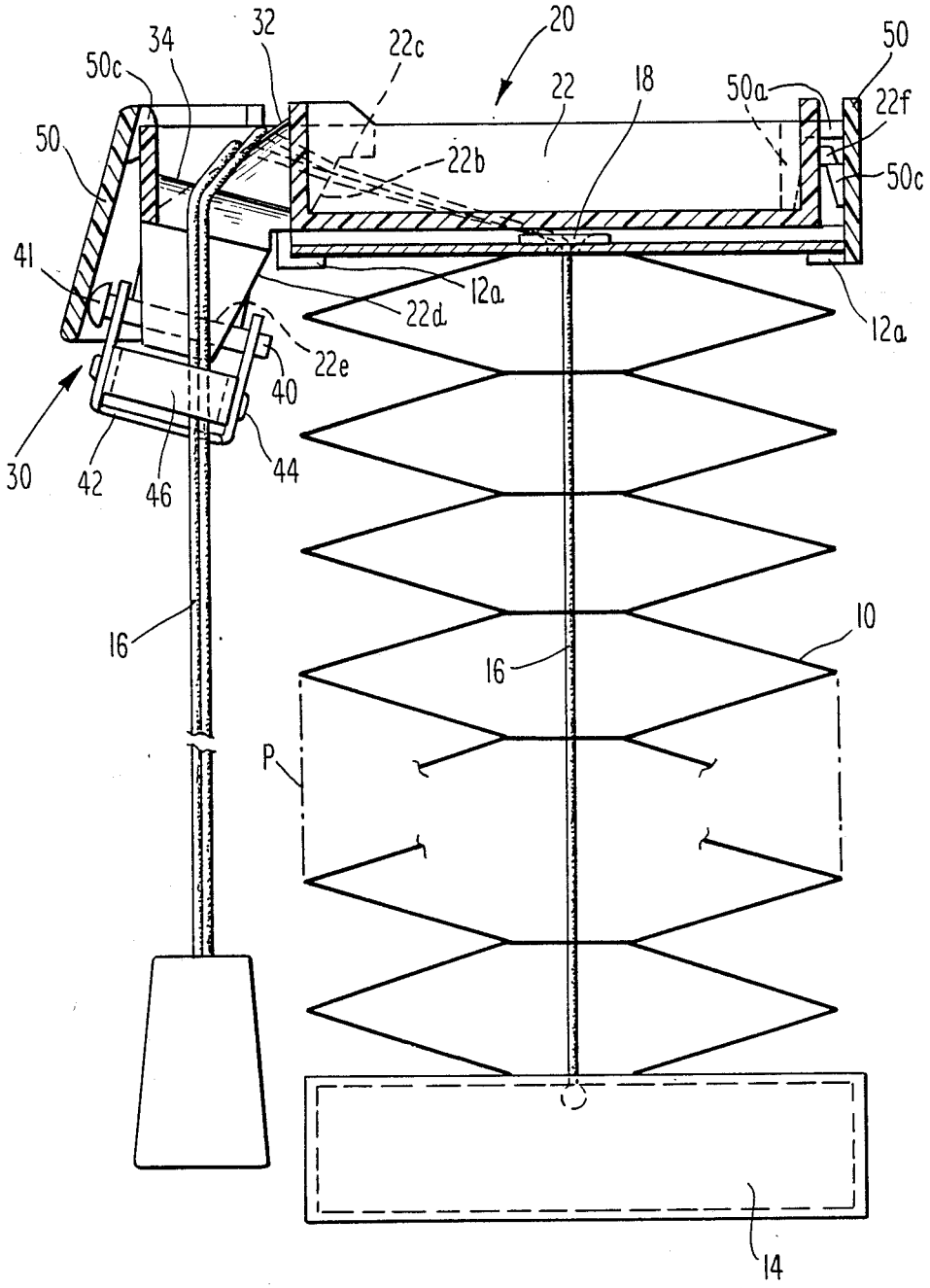
FIG. 3 is a cross sectional view taken generally along the line 3—3 of FIG. 2.

As shown in FIG. 2, the tongue portion 22*a* of the molded body 22 extends into an elongated recess in the headrail 12 which is typically an aluminum extrusion. The shroud 50 comprises tongues 50*a* and 50*b*, which are confined between the tongue 22*a* of the body 22 and the headrail 12, and further locating tabs 50*c*, which hold the shroud 50 in proper relation to the body 22. Further tabs 22*f* may be formed on body 22 for interaction with tabs 50*c* on the shroud 50. See FIG. 3. The shroud 50 thus hides the visible part of the body 22 (i.e., the part not inserted into the headrail 12) from view in at least the horizontal plane. The tongues on shroud 50 and body 22 are inserted into the headrail together, and are formed so that the headrail need simply be cut off squarely, as indicated at 12*a*. This further simplifies assembly of shades according to the invention.

It will be appreciated that according to the invention, the cords undergo less total change of direction than in the arrangements of the previous U.S. and European designs. This reduces friction and wear. Moreover, the cord is moved in the plane parallel to the shade member in order to operate the shade. As mentioned, this is found to be desirable. Further, the locking dogs are carried by a support member formed integrally with the molded body member 22 and therefore also with the first and second bearing surfaces; this means that the dogs are always properly located with respect to these bearing surfaces, and ensures their proper operation.

It can also be appreciated that the design shown is "crash-proof" ; that is, if the cords are simply released, the dogs will grip them, arresting the motion of the shade member.

While a preferred embodiment of the invention has been discussed in detail, this should not be considered a limitation on the invention, but merely exemplary thereof. The invention is to be limited only by the following claims.

We claim:

1. A window shade comprising an improved cord lock, said shade comprising a headrail, an extensible and collapsible shade member, and two or more cords extending from a lower end of said shade member to the upper end of said shade member and into said headrail, and guide means in said headrail for guiding said cords from their entry into said headrail to a cord lock at one end of said headrail, said cord lock comprising first and second fixed angled bearing surfaces, said cords running from said guide means over said first angled bearing surface and thence over said second angled bearing surface, said first angled bearing surface being angled with respect to the horizontal to direct said cords laterally outwardly of said shade member, and said second angled bearing surface angled with respect to the horizontal in a sense opposite from said first angled bearing surface to direct said cords downwardly in front of said shade member, and locking means for engaging and securing said cord with respect to said headrail.

2. The shade of claim 1, wherein said cord lock comprises a molded body in which are integrally formed said first and second bearing surfaces.

3. The shade of claim 2, wherein said cord lock comprises a third guide surface to guide said cords from said guide means in said headrail to said first angled bearing surface.

4. The shade of claim 3, wherein said third guide surface is also formed integrally with said molded body.

5. The shade of claim 2, wherein said locking means is mounted to said molded body by support means molded integrally with said body, whereby the position of said locking means with respect to said second bearing surface is determined.

6. The shade of claim 5, wherein said locking means comprises a first locking dog member which is urged into securing engagement with said cord by friction between said cord and said first dog member when said cord is in a resistance position with respect to said locking means, and wherein said cord is released by said locking means when said cord is moved to an unlocked position with respect to said locking means, and wherein said first dog member is mounted to said molded body by a pivot pin passing through said support means formed integrally with said molded body.

7. The shade of claim 6, wherein said pivot pin comprises a headed pin which is retained to secure said first dog member on said dog support by a shroud fitting over the periphery of said molded body.

8. The shade of claim 6, wherein said first dog member comprises a generally U-shaped sheet metal member having ears disposed on either side of said dog support, said pivot pin passing through holes formed in said ears and said dog support.

9. The shade of claim 6, wherein said locking dog means comprises a second dog member pivotally joined to said first dog member, said cords passing between said first and second dog members and being frictionally engaged thereby upon movement of said cords and said locking dog means from an unlocked to an engaged position with respect to said dog support.

10. The shade of claim 9, wherein said second dog member is a U-shaped sheet metal member having ears disposed on either side of a central portion, and said locking dog means further comprises a second rivet passing through holes in the ears of said first and second dog members to pivotally join said dog members.

11. The shade of claim 9, wherein said first and second dog members pivot about axes in planes generally perpendicular to the plane of the shade member, whereby the motion of said cords between the unlocked and engaged positions occurs in a plane generally parallel to the plane of said shade member.

12. The shade of claim 1, wherein said locking means comprises first and second dog members, the first dog member being pivotally mounted to the cord lock and the second dog member being pivotally mounted to the first dog member, the cords passing between the dog members, the first and second dog members being located such that when the cords are permitted to hang freely, opposed engaging surfaces formed on the first and second dog members touch the cords, whereby said cords are engaged by said locking dog means upon release of said cords.

13. The shade of claim 12, wherein said cords are moved between unlocked and engaged positions to control the shade member, and said motion is such that in so moving the cords are moved away from the second bearing surface.

14. The shade of claim 12, wherein said first dog member is mounted to said cord lock by a dog support integrally molded therewith, said dog support locating said first and second dog members with respect to said second angled bearing surface.

15. A window shade comprising an improved cord lock, said shade comprising a headrail, an extensible and collapsible shade member, two or more cords extending from a lower end of said shade member to the upper end of said shade member and into said headrail, said headrail comprising guide means for guiding said cords along a path extending within said headrail from their entry into said headrail to a cord lock comprising a molded member, and locking means for engaging and securing said cord with respect to said headrail at one end of said headrail.

said molded member being formed to integrally comprise a first bearing surface inclined with respect to the horizontal to direct said cords laterally outwardly of and parallel to their path within said headrail, a second bearing surface inclined with respect to the horizontal in a sense opposite said first bearing surface to direct said cords downwardly in front of said shade member, and support means for said locking means.

16. The shade of claim 15, wherein said second bearing surface is uniformly curved along an axis in a first plane generally perpendicular to the plane of said shade member, and extending upwardly and outwardly from said headrail at an angle to the horizontal.

17. The shade of claim 16, wherein said first bearing surface is uniformly curved along an axis in a second plane perpendicular to the plane of the shade member, and extending outwardly and downwardly from said headrail at a second angle to the horizontal.

18. The shade of claim 17, wherein the second angle is greater than the first angle.

19. The shade of claim 15, wherein said molded member also has formed integrally therein a further guide surface, inclined with respect to the vertical.

20. The shade of claim 19, wherein a horizontal guide surface is formed integrally with and above said inclined guide surface.

21. The shade of claim 15, wherein when said cord is permitted to hang freely, gripping means on said locking means frictionally engage said cord.

22. A window shade comprising:

a headrail;

an expandable and collapsible shade member;

at least two shade control cords, running from a lower end of said shade member up to an upper end of said shade member, into said headrail, and to one end of said headrail;

a cord lock assemble disposed at said one end of said headrail, said cord lock assembly comprising:

a molded body member, comprising first and second integral bearing surfaces for directing said cords laterally outwardly of said shade member, and downwardly in front of said shade member, respectively, and integral locking mechanism support means; and a locking mechanism mounted to said locking mechanism support means; and a molded shroud member formed of a different material than said molded body member which encloses and hides the periphery of said molded body member.

23. The shade of claim 22, wherein the locking mechanism comprises a locking dog member mounted to said support means by a pivot pin, and said shroud comprises a surface preventing removal of said pin from said support means.

24. The shade of claim 22, wherein said locking mechanism comprises a first U-shaped locking dog member mounted to said locking mechanism support means by a pivot pin passing through holes in each, whereby said locking dog member is positively located with respect to said integral guide surfaces.

25. The shade of claim 24, wherein said locking mechanism further comprises a second locking dog member pivotally fixed to said first locking dog member, said cords being disposed between said first and second locking dog members, so that when said cord is permitted to hang freely, opposed gripping surfaces on said first and second locking dog members touch said cords, whereby said first and second locking dog members engage said cords when said cords are released.

26. The shade of claim 22, wherein said shroud is snap-fit onto said molded body member.

27. The shade of claim 22, wherein said headrail is an elongated member of invariant cross-section defining an interior recess, and said body member and said shroud both comprise tongue members fitting together into and retained in said recess.

28. The shade of claim 27, wherein said body member and shroud meet said headrail at a square end thereof.

* * * * *

UNITED STATES PATENT AND TRADEMARK OFFICE

CERTIFICATE OF CORRECTION

PATENT NO. : 4,913,210

DATED : April 3, 1990

INVENTOR(S) : Wendell B. Colson et al.

It is certified that error appears in the above-identified patent and that said Letters Patent is hereby corrected as shown below:

Title page:

Under heading references cited, sub-heading foreign patent documents, please change the name of the country of Patent No. 0059807 from "Japan" to --European--.

Signed and Sealed this

First Day of October, 1991

*Attest:*

HARRY F. MANBECK, JR.

*Attesting Officer*

*Commissioner of Patents and Trademarks*